US006271751B1

(12) United States Patent
Hunt et al.

(10) Patent No.: US 6,271,751 B1
(45) Date of Patent: Aug. 7, 2001

(54) MAGNETIC LOCK AND STATUS DETECTION SYSTEM AND METHOD THEREFOR

(75) Inventors: Robert C. Hunt; Senthil Kumar, both of Reno, NV (US)

(73) Assignee: Securitron Magnalock Corp., Sparks, NV (US)

( * ) Notice: Subject to any disclaimer, the term of this patent is extended or adjusted under 35 U.S.C. 154(b) by 0 days.

(21) Appl. No.: 09/382,012

(22) Filed: Aug. 24, 1999

(51) Int. Cl.[7] ..... G08B 29/00; E05B 45/06

(52) U.S. Cl. ..... 340/514; 340/515; 340/542; 340/545.1; 70/263; 324/260; 324/263; 324/527; 335/295

(58) Field of Search ..... 340/514, 515, 340/542, 545.1; 70/91, 262, 263, 264, 277; 324/260, 263, 527, 227, 228; 335/253, 295; 318/266, 430, 53, 54

(56) References Cited

U.S. PATENT DOCUMENTS 4,287,512 9/1981 Combs ..... 340/542
4,516,114 5/1985 Cook ..... 340/542
5,261,713 * 11/1993 Fischbach ..... 292/251.5
5,633,626 * 5/1997 Cawthorne ..... 340/545

* cited by examiner

*Primary Examiner*—Donnie L. Crosland
(74) *Attorney, Agent, or Firm*—Oppenheimer Wolff & Donnelly LLP

(57) ABSTRACT

An electromagnetic lock and status detection system and method therefor includes an armature, an electromagnet, and a status detection unit. The electromagnet is magnetically attracted to the armature into a mating relationship. A relatively high inductance is established in the electromagnet when the electromagnet is properly mated with the armature, and a relatively low inductance is established in the electromagnet when the electromagnet is not properly mated with armature. The status detection unit is coupled to the electromagnet to monitor the locking strength between the electromagnet and the armature. The unit monitors the locking strength by altering voltage level provided to the electromagnet and measuring the counter EMF induced in the electromagnet.

35 Claims, 2 Drawing Sheets

MAGNETIC LOCK AND STATUS DETECTION SYSTEM AND METHOD THEREFOR

FIELD OF THE INVENTION

This invention relates to magnetic locks for movable closures such as doors, gates, or the like, including arrangements for determining the secure or not secure status of the magnetic lock by altering the voltage level to the electromagnet and measuring the counter electromotive force (EMF) induced in the electromagnet.

BACKGROUND OF THE INVENTION

Magnetic locking assemblies are widely used to prevent removal or relative motion between parts. For example, such assemblies may be used as locks to secure movable closures such as doors, gates, or the like. Magnetic locking assemblies are also commonly used as magnetic fasteners, mounting structures, lifters, couplings, theft protection contrivances, and the like. To secure a door, a typical electromagnetic lock includes an electromagnet body mounted on a door frame, and a ferrous metal armature plate mounted on the door. When energized, the electromagnet generates a sufficient magnetic attractive force to firmly hold the armature plate and the door against the electromagnet. This energized condition defines a locked condition. The door may be conveniently unlocked by switching off the electrical current to the electromagnet by any one of a number of devices such as a digital keypad or a card reader.

Two requirements should be met for an electromagnetic lock to properly secure a door. First, the electromagnetic lock should be sufficiently energized to generate a holding force adequate to prevent a forced opening of the door. Secondly, the electromagnet should be properly mated to the armature plate. The electromagnetic lock is considered "locked" when these two requirements are met.

To enhance security within a facility equipped with an electromagnetically locked door, the status of the door and/or electromagnetic lock can be monitored by one or more devices which define part of the building security system and which are tied into the building security system wiring. Door status (whether the door is opened or closed) is very commonly detected by magnetic contacts mounted on the door. These magnetic contacts change state as the door opens and closes. Electromechanical plunger switches can also perform the function of detecting door status. Higher order security information, however, is provided by various methods of detecting whether the electromagnetic lock is securing the door. Although the door may be closed, this does not necessarily mean that the door is properly secured. The facility therefore has a clear interest in detecting that the door is secured rather than merely closed. Accordingly, prior art electromagnetic locks have included lock status detection system to provide this important information to the building security system.

In facilities where a high level of security must be maintained, such as a prison or bank, it can be expected that intruders and saboteurs will attempt to defeat the magnetically locked door without alerting the building security system. Prior art magnetic lock status detection systems have weaknesses when they are employed in higher security facilities in that they are relatively easy to defeat. Several devices are currently available to determine the lock status of electromagnetic locks. However, each of the prior art has associated shortcomings.

One attempt to satisfy the needs discussed above is disclosed in U.S. Pat. No. 4,287,512 issued to Combs.

Combs teaches mounting a Hall-effect device within the magnetic lock adjacent to the magnetic core. The Hall-effect device is able to detect varying intensities of a magnetic field. The field adjacent to the magnetic core will be more intense when the lock is not secured, i.e., when the electromagnet is not coupled with an armature plate. When the electromagnetic lock is secure, the magnetic field from the electromagnetic core is directed into the armature plate, thus diminishing the intensity of the magnetic field at the point at which the Hall-effect device is positioned.

A similar method found in commercially available products replaces the Hall-effect device with a magnetic reed switch which is also able to detect an alteration in the magnetic field intensity adjacent to the core of the electromagnet.

The monitoring systems utilizing a Hall-effect device (as disclosed in Combs) or a magnetic reed switch may also be defeated. The Hall-effect device or the reed switch is generally positioned at one end of the magnetic core. In the event that an intruder places an object creating an air gap at the other end of the electromagnetic lock, the armature can be made to tilt away from the magnet body at this other end. The resultant air gap is sufficient to reduce the holding force of the electromagnetic lock to the point where it is not secure. However, since the armature plate rests against the core at the end where the Hall-effect device or reed switch is mounted, the magnetic field is still diverted into the armature at that point, and the status detection system is, thereby, defeated. This method of defeating the monitoring system may be counteracted by mounting multiple Hall-effect devices or magnetic reed switches around the periphery of the magnetic core, but this increases the cost and complexity of the system.

Another effective method of defeating the monitoring system disclosed in Combs is the introduction of a powerful permanent magnet to the outside of the electromagnet body. The localized interaction of the permanent magnet's magnetic field can be positioned so as to null the electromagnetic field when it increases in intensity owing to the decoupling of the electromagnet body from the armature plate. In this event, the status detection circuit will continuously report secure even when the door is fully opened.

In addition to being vulnerable to the defeating methods described above, the monitoring systems disclosed in Combs and the magnetic reed switch techniques also have incorporated with it issues of sensitivity. The Hall-effect device or magnetic reed switch must be carefully positioned in controlled proximity to the magnetic core in order to reliably detect the secure status of the electromagnetic lock. The positioning cannot be allowed to shift with time, so the Hall-effect device or magnetic reed switch is generally secured by permanently potting the core in a material such as epoxy. Thus, the Hall-effect device or magnetic reed switch is usually unrepairable. In the event of failure of this component, the entire electromagnet assembly must be replaced. This also creates the commercial disadvantage of two different models of electromagnetic lock being offered: one with status detection and one without.

Reference is also made to U.S. Pat. No. 4,516,114 issued to Cook in which the magnetic core of the electromagnet acts as a status detection switch. The core is divided into three segments. When the armature is pulled strongly down against the core by the power of the electromagnetic field, a circuit is closed between the armature plate itself and the two isolated segments of the core. This circuit closure is employed to detect and report to the building security system that the electromagnetic lock is holding secure.

The status detection system disclosed in Cook may be defeated by placing a nonferrous, but electrically conductive material between the armature plate and the electromagnet body such as a thin aluminum plate or aluminum foil. With the door closed, a circuit would be closed between the two segments of the magnetic core and the intervening aluminum plate or foil which is being pressed against the magnetic core by the armature plate. The building security system would read the lock as secure. However, the intervening aluminum creates an air gap sufficiently large to substantially reduce the holding power the electromagnetic lock. For example, an air gap of 0.015 inch may allow an intruder to easily push the door open.

Accordingly, a need exists for an improved magnetic lock status detection method which will be resistant to tampering.

BRIEF SUMMARY OF THE INVENTION

In accordance with the present invention, a security device for securing a closure that is movable within a support frame from a secured position to an unsecured position and back is provided. In general, the closure is secured through the use of an electromagnetic lock and status detection system. In the exemplary embodiment, the magnetic armature plate is mounted on a door, and an electromagnet is mounted onto a support frame of the door.

When a ferrous body such as the armature of a door is brought into proximity with the electromagnet, the magnetic field is concentrated, and the inductance of the electromagnet coil is increased. Thus, the inductance of the electromagnet is indicative of door status. A relatively low inductance means that no armature is near the coil of the electromagnet, i.e., that the door is open. A relatively high inductance means that the armature plate properly abuts the electromagnet, thus indicating that the door is fully closed and secured. The inductance of the electromagnet is one component of its reactance. Thus, whether the armature is closely and properly coupled to the electromagnet can be detected by sensing a reactive response characteristic of the electromagnet.

In a preferred embodiment of the present invention, a status detection unit according to the present invention is placed in series between an electromagnet power supply and the respective plus and minus leads of the electromagnet. At periodic intervals the status detection unit switches off the power to the electromagnet for a short period of time. The power to the electromagnet is switched off about once every two minutes for about 15 milliseconds (ms). The holding force of the door is not significantly decreased when the power is switched off due to the magnetic inertia of the electromagnet. During the 15 milliseconds, the collapsing magnetic field induces a counter electromotive force (EMF) in a coil of the electromagnet which, together with the electromagnet core and the armature if an armature is present, has an appreciable inductance. At the moment just prior to restoring power to the electromagnet, the status detection unit measures the counter EMF induced in the coil. Because the counter EMF detected at the 15 ms time point is a function of the inductance of the coil and hence is a function of how close the armature is to the electromagnet, measuring the counter EMF at the 15 ms point provides an indication of whether the door is fully closed and properly secured, whether the door is fully open and unsecured, or whether the door is closed and unsecured. The door may be closed and unsecured when a small gap air gap exists between the electromagnet and the armature.

Other objects, features, and advantages of the present invention will become apparent from a consideration of the following detailed description and from the accompanying drawings.

DETAILED DESCRIPTION OF THE PREFERRED EMBODIMENTS

Figure 1:
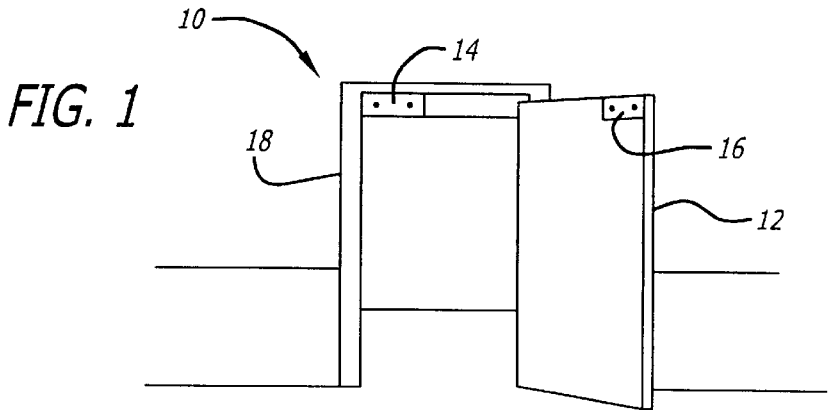
FIG. 1 is a perspective view of an electromagnetic lock and status detection system used to secure a door in accordance with the present invention.

The present invention relates to an electromagnetic lock and status detection system. The lock and detection system is suited to prevent removal or relative motion between parts. In the particular embodiment shown in the drawings and herein described, the lock and detection system is designed to secure a door. However, it should be understood that the principles of the present invention are equally applicable to virtually any lock and detection system which prevents removal or relative motion between parts. Therefore, it is not intended to limit the principles of the present invention to the specific embodiment shown and such principles should be broadly construed.

Referring to FIG. 1, an electromagnetic lock and status detection system 10 is configured to secure a door 12. The lock and detection system 10 includes an electromagnet 14 and an armature plate 16. The electromagnet 14 is suspended under a door frame 18, and the armature plate 16 is mounted on the door 12. When the door 12 is closed, the armature plate 16 contacts the electromagnet 14 and secures the door 12.

Figure 2:
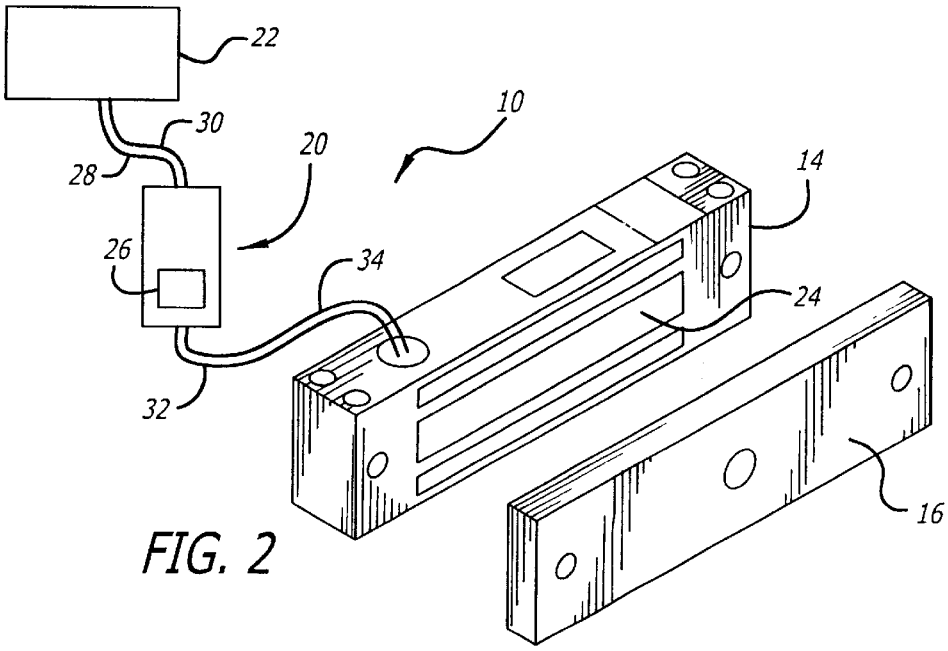
FIG. 2 is a close up perspective view of the electromagnetic lock and status detection system shown in FIG. 1.

Referring now to FIG. 2, an enlarged view of the lock and detection system 10 is shown to further include a status detection unit 20 and an electromagnet power supply 22 coupled to the electromagnet 14. The electromagnet 14 has an electromagnetic core 24 which magnetically couples with the armature plate 16. The status detection unit 20 includes a circuit board 26. The circuit board 26 is operatively connected between the power supply 22 and the electromagnet 14 by power lines 28, 30, 32, 34. The power supply 22 converts the building line voltage to an appropriate DC voltage of either 12 or 24 volts. It is noted that any appropriate voltage other than 12 or 24 volts may be used as long as the electromagnet is properly energized. Furthermore, a battery may be used to energize the electromagnet and power the status detection unit.

Figure 3:
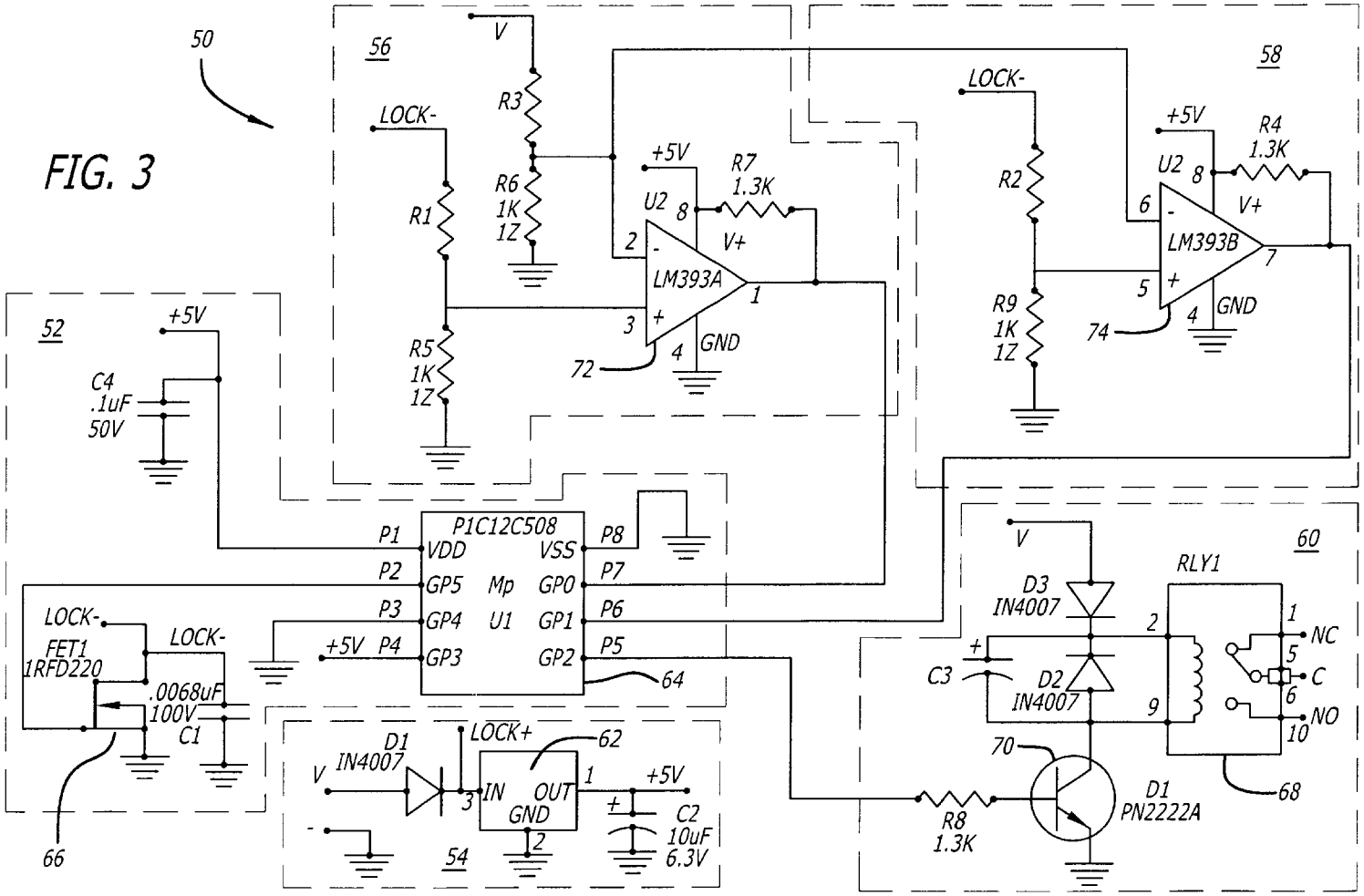
FIG. 3 is a schematic circuit diagram of the status detection unit shown in FIG. 2.

FIG. 3 is a detailed schematic of a preferred embodiment of the electromagnetic lock and status detection system 50. The system 50 comprises a logic unit 52, DC bias unit 54, a first comparator unit 56, a second comparator unit 58, a relay unit 60, and an electromagnet unit (not shown). The LOCK+ and LOCK− signals are connected to power leads 32 and 34 of electromagnet 14.

Input power (shown as "V") from a power supply is connected to several points in the schematic shown in FIG. 3. In operation, when power is first applied to the system 50, a voltage regulator 62 powers up a microprocessor 64. The microprocessor 64 then begins to execute its stored program and immediately turns on the electromagnet by activating pin P2 of the microprocessor 64 which turns on a field effect transistor 66, thereby switching on the electromagnet. The system 50 remains in this state (the electromagnet remaining "on") for two minutes in the case of the preferred embodiment. Although this dwell time could be set as one would wish in the embedded software of the microprocessor 64. The relay 68 is also energized when pin P5 of the microprocessor 64 turns on a bipolar transistor 70 which controls the relay 68. At the end of two minutes, the microprocessor 64 turns "off" power to the electromagnet for a period of 15 milliseconds. This time period is insufficient for the holding force of the electromagnet to appreciably diminish due to the magnetic inertia of the electromagnet. It is noted that the present invention is not limited to a time period of 15 milliseconds. Depending on the configuration of the electromagnet, the time period may be less than or greater than 15 milliseconds.

At the end of the 15 millisecond time period, the microprocessor 64 repowers the electromagnet. Immediately prior to repowering, the counter EMF has been developed by the partial collapse of the magnetic field. The magnitude of the counter EMF is simultaneously measured by a first operational amplifier 72 and a second operational amplifier 74, wherein the magnitude of the counter EMF is largely dependent upon the inductance of the electromagnet. The status of the electromagnet can be determined by measuring the counter EMF because holding force is dependent upon the inductance of the electromagnet.

If the counter EMF is less than a level 1 (120 volts for an exemplary embodiment), neither the first operational amplifier 72 nor the second operational amplifier 74 will turn on. This condition will arise when the inductance of the electromagnet is substantially below that which would be expected with a properly coupled armature plate (not shown) or a nearly properly coupled armature plate. In this condition, neither operational amplifier 72, 74 will turn "on", and the "off" status of both operational amplifiers 72, 74 is respectively communicated to the microprocessor 64 via pins P7, P6. The microprocessor 64 will then determine that the system 50 is not secure and will turn "off" the bipolar transistor 70. The bipolar transistor 70 will in turn deenergize the relay 68, and the relay 68 will interface with the building security system to announce a breach of security.

If the counter EMF voltage is greater than the aforementioned level 1, but is less than a level 2 (130 volts in an exemplary embodiment), the first operational amplifier 72 will be "on" and the second operational amplifier 74 will be "off". This logic condition will be read by the microprocessor 64 as indicating a level of inductance which indicates that the electromagnet is properly coupled to the armature plate. Accordingly, the relay 68 will be left in its energized state and report to the building security system that the electromagnetic lock and status detection system 50 is secured.

In the event that the counter EMF is greater than the aforementioned level 2, a minor obstruction such as a thin piece of paper is present between the armature plate and electromagnet. In this condition, the electromagnet is not secured to the armature plate at the full holding force and the system 50 is considered partially insecure. This logic condition is detected by the microprocessor 64, and the microprocessor 64 turns off the bipolar transistor 70 so as to de-energize the relay 68 and report to the building security system that the electromagnetic lock and status detection system 50 is not secured.

As long as the electromagnetic lock and status detection system 50 is powered, the embedded program of the microprocessor 64 instructs the system 50 to automatically test the securement status every two minutes. A failure of any test will be immediately reported to the building security system via the output of the relay 68, and the relay 68 will continue to be held in its deenergized the (system 50 is not secure) condition until a subsequent test indicates that the security of the system 50 has been restored.

Figure 4:
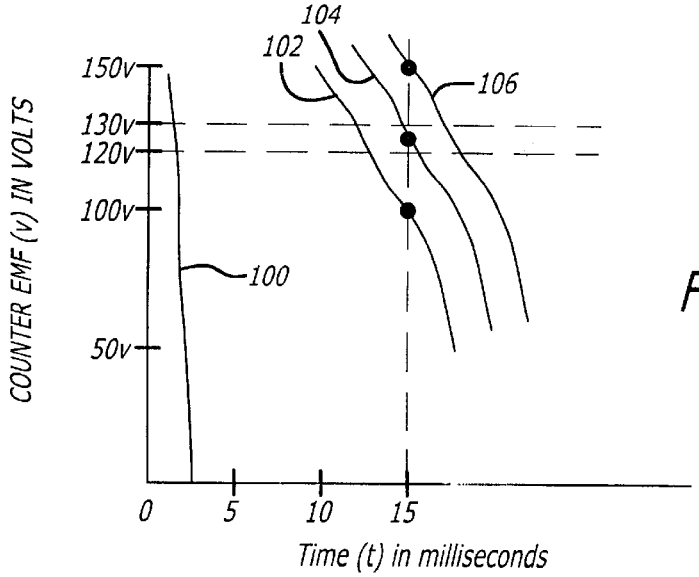
FIG. 4 is a graph illustrating the decay rates of the counter electromotive force depending on the lock status of the electromagnetic lock shown in FIG. 1.

The functional relationship between the counter EMF and the locking status of the electromagnetic lock system 10 can be better understood with reference to FIGS. 2 and 4. FIG. 4 graphs counter EMF against time. At time =0 millisecond, the power to the electromagnet 14 is switched "off". For purposes of clarity, only a portion of the traces 100, 102, 104, 106 are shown. When the electromagnet 14 is deenergized, the counter EMF develops rapidly to a very high peak and then decays at different rates. The different traces 100, 102, 104, 106 are produced by the armature plate 16 being separated by different distances from the electromagnetic core 24.

As shown in FIG. 4, trace 100 represents a state where inductance is at its lowest value because the armature plate 16 is completely separated from the electromagnetic core 24. In this instance, the counter EMF declines to zero prior to the 15 millisecond test period, and the counter EMF is read as zero by the operational amplifiers 72, 74. Trace 102 illustrates an electromagnet 14 with a large air gap between the electromagnetic core 24 and the armature plate 16, on the order of about 0.010 inch. Such a large air gap substantially reduces the holding force of the lock system 10, typically by more than 50 percent. Since the inductance of the electromagnet 14 increases when the separation distance is reduced from a complete separation to a relative large air gap, the counter EMF at the 15 millisecond test period is approximately 90 volts (see trace 102). At 90 volts, both operational amplifiers 72, 74 remain "off" and the lock system 10 reports that the electromagnet 14 is not properly secured to the armature plate 16.

As shown in FIG. 4, trace 104 represents a state where the lock system 10 is fully coupled and holding at full force. The counter EMF at the detection time of 15 milliseconds is read as 125 volts which is within the "secure" window. When the counter EMF is within the "secure" window range, the first operational amplifier 72 turns "on" and the second operational amplifier 74 remains "off".

Trace 106 represents a state where a relatively small air gap exists between the electromagnetic core 24 and armature plate 16 such as would be caused by a piece of paper covering a small area of the core/armature interface surface. Although inductance is lower than in the case of trace 104, the interaction of circuit reactance in this instance delays the decline of counter EMF so that it stands at 150 volts at the measurement time of 15 milliseconds. In this instance, both operational amplifiers 72, 74 turn "on", and this logic condition is read as not secure by the microprocessor 64. It is noted that the position of trace 106 relative to the other traces 100, 102, 104 is counter-intuitive. However, an appropriate time and voltage can be determined for any given electromagnetic lock system without undue experimentation by simply measuring the counter EMF as a function of time under the various secured and unsecured conditions. That is, the response characteristics can be empirically determined by simple testing for any given electromagnet and armature combination. Once the reactive response characteristics of the electromagnet and armature have been characterized, an appropriate time to sample the EMF and an appropriate voltage range can be determined, to ensure that the electromagnetic lock is properly secured.

In an alternative embodiment, the status check unit may include a circuit board similar to the circuit illustrated in FIG. 3 with the exception that only a single operational amplifier is used. The electromagnetic lock would be considered secure any time the operational amplifier is turned "on". In this embodiment, a modest cost savings is achieved, but the security function is lessened. At the 15 millisecond test period, the circuit would only be able to detect a large air gap and would not detect small reductions in holding force. If the measurement time is extended from 15 to 30 milliseconds, for example, detection would become more sensitive. Returning to FIG. 4, trace 104 declines less steeply than trace 106 past the 15 millisecond point so that it reports a higher counter EMF at 30 milliseconds. This can be reliably detected by a single operational amplifier. One of the problems which may be encountered when switching "off" the power to the electromagnet for a 30 millisecond interval is that is that the magnetic inertia is no longer substantially sufficient to keep the door secure, and the door may "pop" open if the secured room is under a positive pressure. Accordingly, the preferred embodiment is cost justified for the majority of applications.

In another embodiment, the input voltage to an electromagnet is reduced (not completely switched "off" as described in the previous embodiments), and an induced counter EMF resulting from the voltage reduction may be measured to determine the status of the electromagnetic lock. Furthermore, the status of the electromagnetic lock may also be determined by increasing input voltage to the electromagnet and measuring the counter EMF resulting from the voltage increase. Still further, in the preferred embodiment described above where power to the electromagnet is switched off, the counter EMF may be measured when power is restored to the electromagnet. The counter EMF values measured in these alternative embodiments may be compared to a determined threshold value to determine whether the lock system is secured or unsecured.

Even more generally, the present invention takes advantage of the fact that the proximity of the armature to the electromagnet causes a change in the reactive response characteristics of the electromagnet. This change in the reactive response characteristics can be sensed using any input voltage which varies according to time, such as switching the current completely off as in the preferred embodiment, or by using a square wave, a sine wave, or any other wave whose DC component is non-zero. The reactive characteristics can also be measured using a variety of techniques, including measuring back EMF as in the preferred embodiment, by measuring the current flow immediately after the input voltage has been increased, or in various other ways that will be apparent to one skilled in the art.

It can be seen that the lock status detection method of the present invention is extremely difficult if not impossible to defeat as it is directly measuring the coupling between the electromagnet and the armature plate by sampling the resultant inductance. If the lock is to be physically defeated, the armature plate needs to be broken loose from the electromagnetic core and this can only occur with a consequent drop in inductance. The methods which are used to defeat the prior art status detention techniques such as inserting obstructions between the electromagnetic core and armature plate and utilizing external permanent magnets will not defeat the present invention.

Although the present invention has been described in detail with reference to the exemplary embodiment and drawings thereof, it should be apparent to those skilled in the art that various adaptations and modifications of the present invention may be accomplished without departing from the spirit and scope of the invention. Accordingly, the invention is not limited to the precise embodiment shown in the drawings and described in detail hereinabove.

What is claimed is:

1. A method of detecting the status of an electromagnetic lock assembly, comprising:

providing an electromagnet and an armature;

magnetically attracting the electromagnet and the armature into a mating relationship by providing power to the electromagnet; and monitoring locking strength between the electromagnet and the armature, switching off the power to the electromagnet for a short period of time less than 30 milliseconds to induce a counter EMF pulse in the electromagnet while maintaining secure holding force; and measuring the counter EMF pulse at a predetermined time while the power to the electromagnet is switched off for said short period of time.

2. The method of claim 1, further comprising mounting the armature on a door and mounting the electromagnet on a frame of the door for relative movement between a closed position whereby the armature properly engages the electromagnet, and an opened position whereby the door is opened and the armature is spaced from the electromagnet.

3. The method of claim 2, further comprising comparing the counter EMF to a threshold voltage range;

wherein the door is opened and unsecured when the electromagnet is completely separated from the armature, and the counter EMF in the electromagnet is zero at the end of the short period of time;

wherein the door is closed and unsecured when a relatively large air gap is between the electromagnet and armature, and the counter EMF in the electromagnet is below the threshold voltage range;

wherein the door is closed and secured when the electromagnet is fully coupled to the armature, and the counter EMF in the electromagnet is within the threshold voltage range; and wherein the door is closed and unsecured when a relatively small gap is between the electromagnet and armature, and the counter EMF in the electromagnet is greater than the threshold voltage range.

4. The method of claim 3, wherein the threshold voltage range is greater than 90 volts and less than 150 volts.

5. The method of claim 2, further comprising:

providing an electromagnet power supply to energize the electromagnet;

providing a status detection unit for said step of monitoring the locking strength between the electromagnet and the armature; and operatively placing the status detection unit in series between the electromagnet power supply and a lead of the electromagnet.

6. The method of claim 1, whereby the electromagnetic lock assembly is secured and remains secured during the short period of time due to a magnetic inertia of the electromagnet.

7. The method of claim 1, whereby the power to the electromagnet is switched off about once every two minutes.

8. The method of claim 1, whereby the short period of time is about fifteen milliseconds.

9. The method of claim 7, whereby the counter EMF is measured just prior to restoring the power to the electromagnet.

10. A method of detecting whether an electromagnetic lock assembly is properly closed and secured, comprising:

characterizing electrical response characteristics of an electromagnet as a function of time and further as a function of a distance between the electromagnet and an armature;

determining an appropriate time for measuring the electrical response after a voltage input to the electromagnet has been switched;

switching power to the electromagnet for a brief period of time to provide a counter EMF pulse while maintaining a secure holding force;

waiting a time period equal to the appropriate time;

detecting the electrical response from said pulse at the determined appropriate time; and correlating the electrical response to a secured or unsecured status of the electromagnetic lock assembly.

11. The method of claim 10, wherein one of the electrical response characteristics is an induced counter EMF.

12. The method of claim 10, wherein the electrical response characteristics are reactance characteristics.

13. The method of claim 10, wherein said step of detecting the electrical response characteristics includes measuring a counter EMF induced in the electromagnet.

14. The method of claim 13, wherein said step of switching power to the electromagnet includes switching off the power to the electromagnet.

15. The method of claim 14, wherein locking strength remains sufficient to prevent forced separation of the electromagnet and the armature when the power to the electromagnet is switched off due to the magnetic inertia of the electromagnet.

16. The method of claim 14, wherein said step of correlating the electrical response includes comparing the counter EMF to a threshold voltage range;

wherein the electromagnetic lock assembly is opened and unsecured when the electromagnet is completely separated from the armature, and the counter EMF in the electromagnet is zero at the appropriate time;

wherein the electromagnetic lock assembly is closed and unsecured when a relatively large air gap is between the electromagnet and armature, and the counter EMF in the electromagnet is below the threshold range;

wherein the electromagnetic lock assembly is closed and secured when the electromagnet is fully coupled to the armature, and the counter EMF in the electromagnet is within the threshold voltage range; and wherein the electromagnetic lock assembly is closed and unsecured when a relatively small gap is between the electromagnet and armature, and the counter EMF in the electromagnet is greater than the threshold voltage range.

17. The method of claim 14, wherein the electromagnet is switched off for about 15 milliseconds.

18. The method of claim 10, further comprising attaching the armature on a door and attaching the electromagnet on a frame of the door for relative movement between a closed position whereby the armature properly engages the electromagnet, and an opened position whereby the door is opened and the armature is spaced from the electromagnet.

19. The method of claim 10, further comprising:

providing an electromagnet power supply to power the electromagnet;

providing a status detection unit for said step of monitoring the locking power between the electromagnet and the armature; and operatively placing the status detection unit in series between the electromagnet power supply and respective plus and minus leads of the electromagnet.

20. The method of claim 10, whereby the electromagnetic lock assembly remains secured when the power to the electromagnet is switched off due to a magnetic inertia of the electromagnet.

21. The method of claim 10, whereby the power to the electromagnet is periodically switched off about once every two minutes.

22. The method of claim 10, whereby the short period of time is about fifteen milliseconds.

23. The method of claim 13, wherein said step of switching the power to the electromagnet includes increasing the power to the electromagnet, and wherein said step of correlating the electrical response includes comparing the counter EMF to a threshold voltage range.

24. The method of claim 13, wherein said step of switching the power to the electromagnet includes decreasing the power to the electromagnet, and wherein said step of correlating the electrical response includes comparing the counter EMF to a threshold voltage range.

25. An apparatus for detecting whether an electromagnetic lock is properly secured, comprising:

a switch for altering a voltage level provided to the electromagnetic lock;

a sensor for detecting an EMF produced within the electromagnetic lock in response to the voltage level being altered;

an electromagnet;

an armature magnetically attracted to the electromagnet into a mating relationship;

a power supply for supplying the voltage level;

a door on which the armature is mounted;

a door frame on which the electromagnet is mounted such that the relative movement of the door between a closed position whereby the armature engages the electromagnet, and an opened position whereby the door is open and the armature is spaced from the electromagnet;

a status detection unit;

wherein the switch turns off power to the electromagnet for a short time period and the EMF is a counter EMF wherein the sensor detects the counter EMF and the status detection unit compares the counter EMF with a threshold voltage;

wherein the door is opened and unsecured when the electromagnet is completely separated from the armature, and the counter EMF in the electromagnet is substantially zero at the appropriate time;

wherein the door is closed and unsecured when a relatively large air gap is between the electromagnet and armature, and the counter EMF in the electromagnet is below the threshold range;

wherein the door is closed and secured when the electromagnet is fully coupled to the armature, and the counter EMF in the electromagnet is within the threshold voltage range; and wherein the door is closed and unsecured when a relatively small gap is between the electromagnet and armature, and the counter EMF in the electromagnet is greater than the threshold voltage range.

26. The apparatus of claim 25, wherein a locking strength of the electromagnetic lock during the short time period is sufficient to prevent the door from being forcibly opened.

27. A magnetic lock and status detection system, comprising:

an armature;

an electromagnet magnetically attracted to the armature into a mating relationship;

a status detection unit coupled to the electromagnet to monitor the locking strength between the electromagnet and the armature, wherein the unit switches off power to the electromagnet for a short period of time while maintaining secure holding force, and measures a counter EMF pulse induced in the electromagnet.

28. The system of claim 27, further comprising:

a door on which the armature is mounted; and a door frame on which the electromagnet is mounted such that relative movement of the door between a closed position whereby the armature engages the electromagnet, and an open position whereby the door is open and the armature is spaced from the electromagnet.

29. The system of claim 27, further comprising a threshold voltage range;

wherein the status detection unit indicates that the door is opened and unsecured when the armature is completely separated from the electromagnet such that the counter EMF is zero at the end of the short period of time;

wherein the status detection unit indicates that the door is closed and unsecured when a relatively large air gap is between the electromagnet and armature such that the counter EMF in the electromagnet is below the threshold voltage range;

wherein the status detection unit indicates that the door is closed and secured when the electromagnet is fully coupled to the armature such that the counter EMF in the electromagnet is within the threshold voltage range; and wherein the status detection unit indicates that the door is closed and unsecured when a relatively small air gap is between the electromagnet and armature such that the counter EMF in the electromagnet is greater than the threshold voltage range.

30. The system of claim 27, wherein the door remains in a secured state when the electromagnet is switched off for the short period of time due to a magnetic inertia of the electromagnet.

31. The system of claim 27, wherein the electromagnet includes an electromagnetic coil, wherein a collapsing magnetic field induces the counter EMF, and the counter EMF is measured just prior to restoring the power to the electromagnet, wherein the counter EMF is within a particular threshold range when the electromagnet is properly mated with the armature, and wherein the counter EMF is outside the particular threshold range when the electromagnet is not properly mated with the armature.

32. The system of claim 27, wherein the counter EMF is measured when the power is restored to the electromagnet.

33. The system of claim 27, wherein the counter EMF is measured immediately before restoring power to the electromagnet.

34. A method of detecting the status of an electromagnetic lock assembly, comprising:

providing an electromagnet and an armature;

magnetically attracting the electromagnet and the armature into a mating relationship by providing power to the electromagnet; and monitoring locking strength between the electromagnet and the armature, comprising:

switching off the power to the electromagnet for a short period of time less than 30 milliseconds to induce a counter EMF pulse in the electromagnet while maintaining secure holding force;

measuring the counter EMF pulse during said short period of time; and actuating a status detection circuit responsive to the measurement of the counter EMF pulse.

35. A method as defined in claim 34 wherein said security indicating circuit is actuated only if said counter EMF pulse is within a predetermined range, and is not above or below said range.

* * * * *